United States Patent [19]

Ziegelbaum

[11] Patent Number: 4,526,365

[45] Date of Patent: Jul. 2, 1985

[54] EXERCISING DEVICE SUITABLE FOR PHYSICAL THERAPY AND THE LIKE

[76] Inventor: Zelik Ziegelbaum, 6787 Booth St., Apt. 2G, Forest Hills, N.Y. 11376

[21] Appl. No.: 476,721

[22] Filed: Mar. 18, 1983

[51] Int. Cl.[3] ..... A63B 23/04

[52] U.S. Cl. ..... 272/96

[58] Field of Search ..... 272/135-139, 272/96, 69, 141, 70, 68, 94, 119, 97; 128/25 B, 25 R, 80 R, 581-585, 80 E, 80 H, 80 G, 132, 149, 153; 273/414; 36/1, 7.5, 132, 135, 106, 114, 95, 96

[56] References Cited

U.S. PATENT DOCUMENTS

| | | | |
|---|---|---|---|
| 2,335,240 | 11/1943 | Medaris | 128/25 R |
| 2,736,971 | 3/1956 | Elsey | 128/581 |
| 2,830,816 | 4/1958 | Uhl | 272/96 |
| 3,472,508 | 10/1969 | Baker et al. | 272/96 |
| 3,584,402 | 6/1971 | Silverman | 36/7.5 |
| 4,279,415 | 7/1981 | Katz | 272/70 |
| 4,361,970 | 12/1982 | Wren et al. | 36/114 |
| 4,397,105 | 8/1983 | Richardson | 36/114 |
| 4,444,389 | 4/1984 | Wrucke | 272/96 |

FOREIGN PATENT DOCUMENTS

| | | | |
|---|---|---|---|
| 998243 | 7/1965 | United Kingdom | 272/96 |

*Primary Examiner*—Richard J. Apley
*Assistant Examiner*—S. R. Crow
*Attorney, Agent, or Firm*—Posnack, Roberts, Cohen & Spiecens

[57] ABSTRACT

An exercising device, especially for physical therapy, is formed of two planar members connected at an angle and sandwiching therebetween a sponge member of angular conformation to constitute a compressible structure. The sponge member is replaceable to provide selectivity with respect to compression and with respect to angular relationship between the planar members. A further planar member is optionally and adjustably connected to the compressible structure to provide a heel rest. A strap is provided to encircle the compressible structure and to hold an operator's extremity, such as a foot or hand, thereon. Flat rigid members are optionally usable to enable the device to be employed for dorsiflexion rather than plantiflexion. In this case the structure is mounted on top of the foot with the rigid members sandwiching the foot and exercising device therebetween.

8 Claims, 4 Drawing Figures

EXERCISING DEVICE SUITABLE FOR PHYSICAL THERAPY AND THE LIKE

FIELD OF INVENTION

This invention relates to exercising devices for exercising, for example, body extremities such as hands and feet and more particularly to devices especially suitable for physical therapy, although not limited thereto.

BACKGROUND

Many exercising devices are known which utilize compression resistance to afford physical exercise for the hands and/or feet of persons utilizing the same. Some of these devices are shown in U.S. Pat. Nos. 1,549,710; 2,944,530; 3,265,389; 3,413,243; 3,658,326; 3,910,572 and 4,040,619.

G. Campbell shows in U.S. Pat. No. 1,549,710 a physical apparatus for developing the muscles and tendons of the fingers, hands, wrists and forearms. This apparatus includes a solid hand grip of a length commensurate with the width of the hand and of elongated form and transverse dimensions appropriate to the application. The grip is constructed of resilient sponge rubber to resist the closing pressure of the fingers to promote muscular strain for the development of muscles.

M. Cohan in U.S. Pat. No. 2,944,530 discloses a device for developing a bowler's grip. The developer disclosed comprises opposed thumb and finger grip members and a compressible resilient pad interposed between and connected to the opposed inner ends of the grip member. There are provided various grooves in different positions and of different designs to accommodate the different fingers of the user.

In U.S. Pat. No. 3,265,389, E. Carlson reveals a hand exerciser, the purpose of which is to incorporate a novel shape and characteristics which enable it to be manipulatively held in various positions for exercising different parts of the hand. The exerciser moreover has different portion of unlike compressibility thereby causing a somewhat sequential compressive action of the device as it is squeezed.

D. Griffin shows an orthopedic exercising device in U.S. Pat. No. 3,413,243. The device is in the form of a ball formed of interconnected air cells defined by resilient wall membranes. The cells at the periphery of the ball are maintained normally closed to preclude passage of air from within the mass constituting the ball and are opened for expelling and absorbing air on compression of, and relaxation of pressure on the mass.

In U.S. Pat. No. 3,658,326, T. Fawick discloses a hand exercising device constructed of a pair of air-filled rubber bulbs for respective hands. A small passageway connects the bulbs and is longitudinally stretchable. One of the bulbs includes a check valve which opens if the air pressure in the device drops below atmospheric pressure.

In U.S. Pat. No. 3,910,572 is furthermore disclosed by H. Denier a flexible, compressible, hollow bulb of rubber which can be held in the hand and squeezed from a normally expanded to a collapsed condition. A bleed valve is provided in the bulb to provide a restricted air duct through which air may be expelled from the bulb when the bulb is squeezed.

J. Landi discloses in U.S. Pat. No. 4,040,619 a flexible and resilient manually collapsible transparent hour-glass shaped housing containing a loosely held liquid-saturated sponge in each of two chambers of the housing. One chamber is squeezed to drive liquid from one chamber to the other and then the device can be inverted to repeat the exercise.

None of the above devices are particularly suitable for physical therapy selectively with the hands or feet or other such extremities of the operator of the same and none of the aforegoing devices are particularly suitable for adjustment both with respect to compressibility and with respect to angular disposition of the forces of compression relative to the operating extremity.

SUMMARY OF INVENTION

It is an object of the invention to provide an improved exercising device expecially suitable for physical therapy.

Another object of the invention is to provide an improved device particularly suitable with respect to dorsiflexion and/or plantiflexion.

Yet another object of the invention is to provide an improved exercising device particularly suitable for inversion and eversion with respect to side to side rolling of a foot or hand or the like.

Another object of the invention relates to the provision of a construction which is especially adapted for modification or selectivity with respect to compressive resistance and/or angular relationship to the extremity being exercised.

Still another object of the invention relates to a device provided with such improvements as to be able to provide a removable and/or adjustable heel support and elevator.

In achieving the above and other objects of the invention, there is provided an exercising device comprising first and second planar members with a resilient means being provided between the planar members and constituting a compression member to yieldingly resist the forcing of the planar members together. In a preferred embodiment of the invention, a strap is provided which encircles the planar members and the resilient means to hold the same in sandwiched relation. It is to be noted that the sandwiched construction is such that the various members are detachable from one another. Thus the resilient means may, for example, consist of an angular member of a selected angle, thereby to provide for a selected angular relationship between the rigid members which are located on opposite sides of the resilient means. This means that the device may be selectively set up to enable a longitudinal application or transverse application of forces to the extremity being exercised.

As will be shown in detail hereinafter, the aforementioned strap may be of adjustable construction such as of Velcro to accommodate an operator's extremity on a rigid member and to hold this extremity on the exercising device in a manner which avoids fore and aft tilting. Preferably the aforementioned rigid member is of planar conformation. In one optional construction, a second rigid member may be provided on top of the foot with an opening to accommodate the same.

According to a feature of the invention, there may be provided a first rigid member with a telescopic construction to make the same extensible.

The above and further objects, features and advantages of the invention will be found in the detailed description which follows hereinbelow as illustrated in the accompanying drawing.

DETAILED DESCRIPTION

Figure 1:
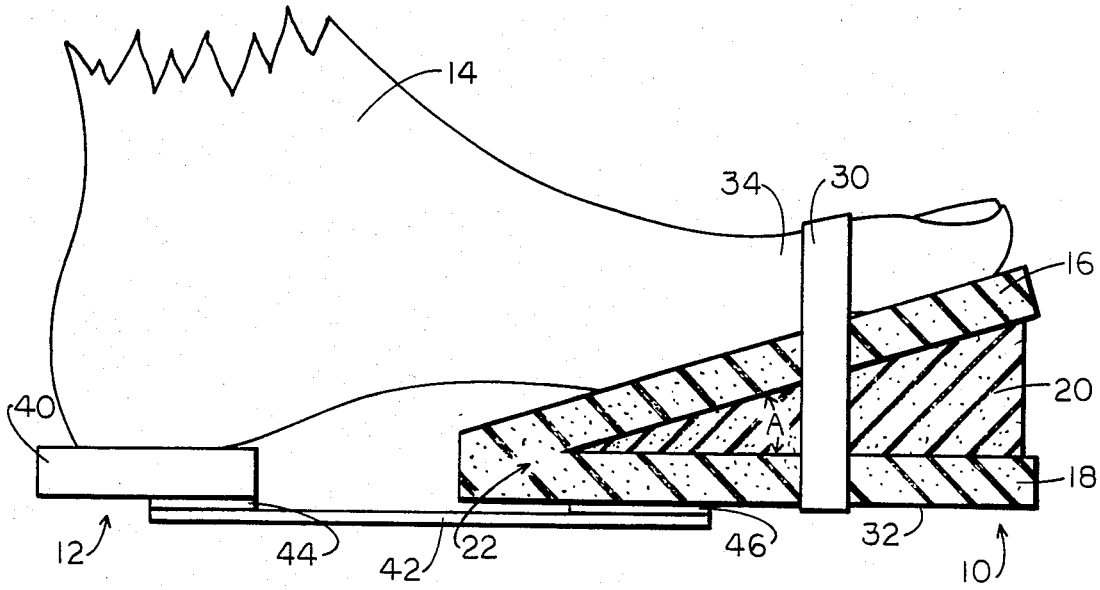
FIG. 1 is a side view of an exercising device provided in accordance with a preferred embodiment of the invention with the foot of an operator being illustrated in order to demonstrate utilization of the device for plantiflexion.
Figure 2:
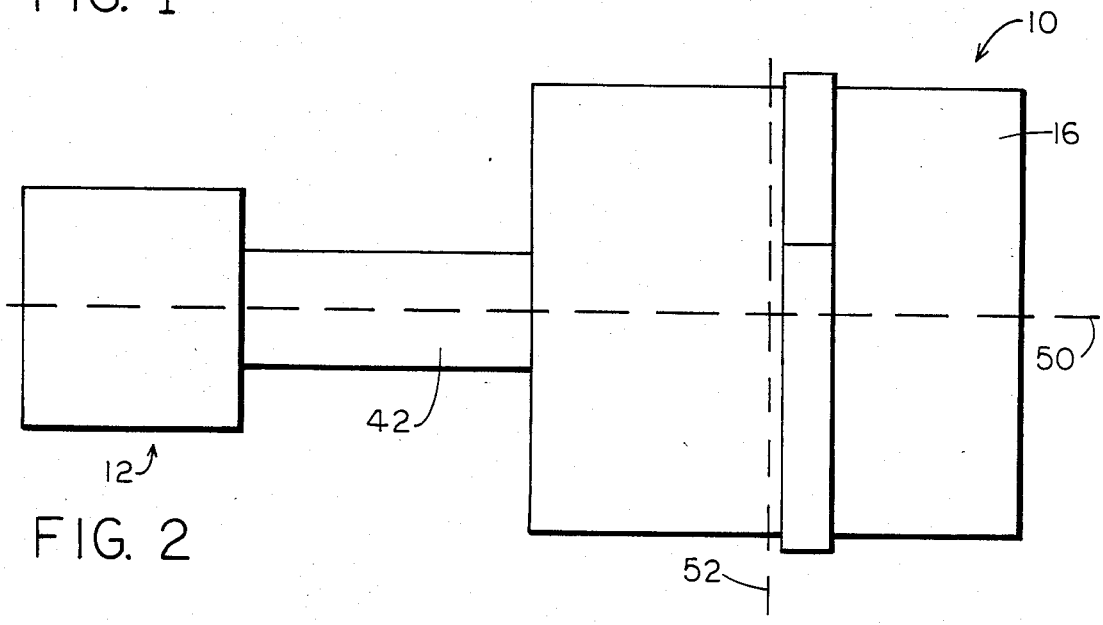
FIG. 2 is a top view of the exercising device of FIG. 1 with the foot removed.

The exercising device of the invention as illustrated in FIGS. 1 and 2 comprises a front portion 10 and a rear portion 12. A foot 14 of an exercising person is illustrated by way of example, although it will be understood that the exercising device, in accordance with the invention, may be utilized with respect to any extremity such as, for example, a hand. The purpose of the invention is generally to provide an improved form of compressive resistance in order that the extremities may be exercised for purposes of muscular development or the like. As will be noted hereinafter, the device of the invention is particularly suitable with respect to dorsiflexion and/or plantiflexion. Moreover, the device is suitable for inversion and eversion with respect to side-to-side rolling of a foot or hand. It will be apparent from the description which follows hereinbelow that the device may be utilized with the user or patient standing or sitting. In this instance, the device will be placed on the floor. The device may also be utilized on a wall with a user, operator, or patient in a reclining position.

In FIG. 1, the front portion of the device includes a first planar member 16 and a second planar member 18. These members may be fabricated of rubber or sponge or the like. They are connected in preferably monolithic relation and in angularly related position and accommodate therebetween a resilient member 20. The resilient member 20 is of a select resiliency which is greater than that of members 16 and 18 and may be formed of a sponge material which may be either natural or synthetic. The member 20 is, for example, of angular conformation enclosing an angle A in the illustrated form.

Member 20 is preferably separate from members 16 and 18. This enables a ready substitution of another resilient member in place of the illustrated member as will be discussed hereinbelow. This substitution provides for facility in selecting compressive resistance or resilience and in selecting angular application of the opposing forces to compression by the member being exercised.

The members 16 and 18 may be entirely separated from one another but are preferably held together in a monolithic structure by an integral hinge arrangement such as indicated at 22. This hinge arrangement may be formed of the same material as constitutes members 16 and 18. This hinge permits an adjustment in the angular relationship between members 16 and 18 and thereby a compression of member 20.

The members 16,18 and 20 are held together in substantially a sandwiched relationship by means of a Velcro strap 30. This Velcro strap may be attached to the bottom 32 of member 18. It encircles the sandwiched members constituting the compressible structure of the device and allows for a space into which the forward section 34 of the foot or other extremity being exercised may protrude. The strap forms the function of holding the exercised extremity onto the member 16 while holding the exercised member together with members 16, 18 and 20 in a sandwiched relationship.

In spaced and co-planar relationship with the member 18 is the planar member 40 which constitutes the rear portion of the exercising device. This member may be formed of plastic, wood, hard rubber or the like. It is optionally connected to the front portion 10. This connection is effected by means of a Velcro strap 42 which connects to Velcro parts 44 and 46 respectively attached to members 18 and 40. The use of Velcro enables a selective attachment of the rear portion 12 to the front portion 10 as well as a control of the spacing therebetween.

Figure 3:
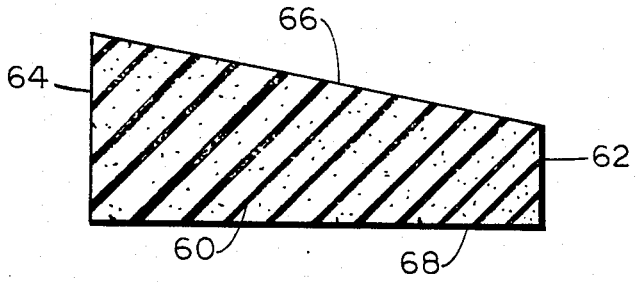
FIG. 3 is a front view of a substitute resilient element for utilization in the apparatus of FIGS. 1 and 2.

As appears in FIG. 2, the front part 10 has a longitudinal axis indicated at 50. It also has a transverse axis as indicated at 52. With the resilient device 20, as illustrated in FIG. 1, the flexion of the foot will take place generally along the longitudinal axis 50. However, in certain physical therapy cases, it is desirable that side to side rolling of the foot, for inversion and eversion, be provided. For this purpose the device 20, which is of angular conformation, can be replaced by the resilient device illustrated in FIG. 3 at 60. This device is also of natural or synthetic sponge. It is of a truncated angular conformation having a short side 62 and a longer side 64 with a top 66 and a bottom 68. This device is positioned along the transverse axis 52 in substitution for the resilient member 20. Whereas the member 20 has a fore and aft slope as appears in FIG. 1, the device of FIG. 3 may have a non-sloping fore and aft conformation if desired. Its principal angle is the angle which slopes transversely of the device and, therefore, effects an angular displacement of the compressive forces resisting movement of the foot when the device is being utilized. Stated otherwise, the resilient device 60 of FIG. 3 tends to tilt the foot in the direction of the lower slope whereby a further and different form of exercise is afforded.

The fact that the resilient device 20 and the resilient device 60 as well are separate bodies, with respect to members 16 and 18, permit their ready interchange and substitution. This means that the forces of compression and angular relationship of the forces may be selectively and readily modified in accordance with requirements. The devices 20 and 60 are shown by way of illustration. It is to be appreciated that an entire series of such devices may be provided wherein the resiliency characteristics are different or graded and wherein the angles are likewise different or graded. This enables control by the operator or physical therapist in such a manner as has not been heretofore available.

From what has been stated above, it will now appear that the invention provides an exercising device consisting of first and second members with a resilient device being provided therebetween to constitute therewith a compression member to yieldingly resist the forcing of the rigid members together in a plantiflexion type exercise. A strap is provided encircling the planar members and resilient device to hold the same in sandwiched relationship. The strap is of adjustable construction to accommodate an operator's extremity on one of the planar members and to hold the extremity in place on the exercising device.

It will also be apparent that the resilient device is of angular conformation and supports the first rigid member at an angle relative to the second rigid member. It will also appear from what has been described above that the rigid members have longitudinal and transverse axes and that the resilient device may establish an angle along one or more of these axes as required.

Figure 4:
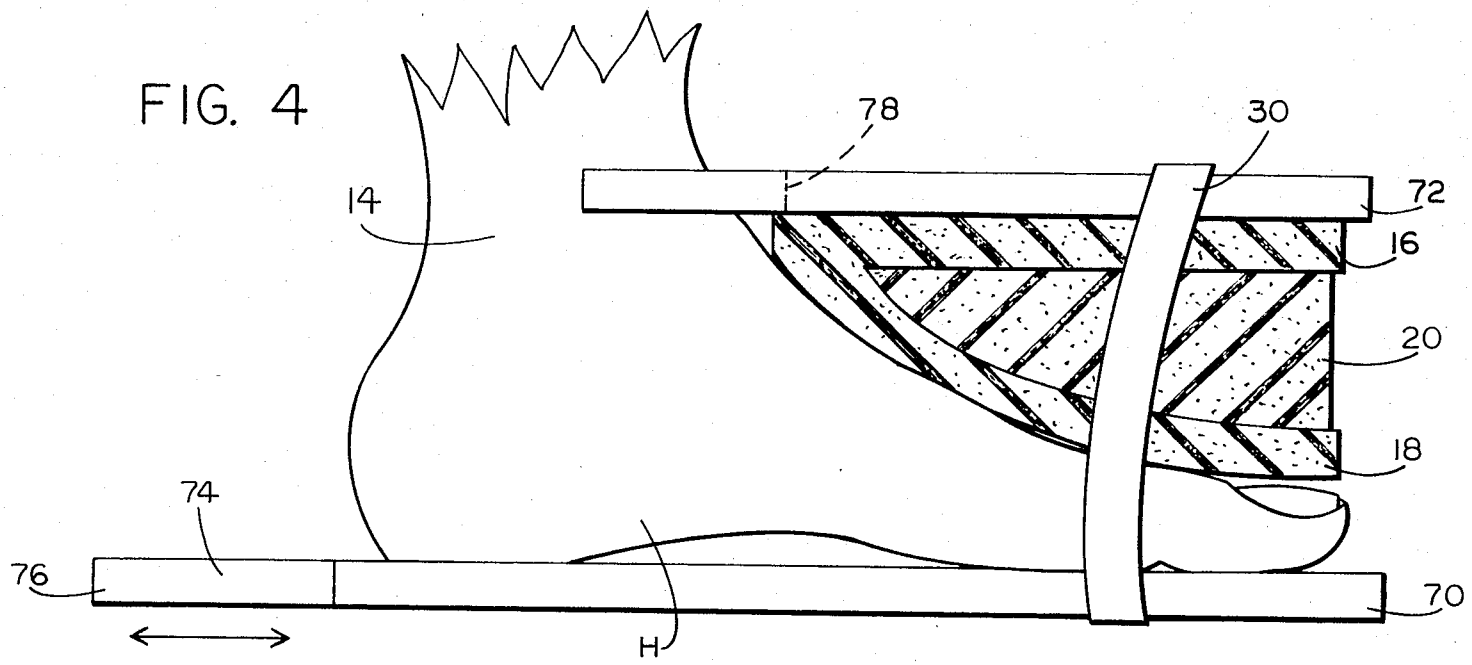
FIG. 4 is a side view with additional parts and mounted for dorsiflexion exercise of the foot of an operator.

FIG. 4 illustrates the compression unit arranged on top of the foot 14 in association with supplemental flat rigid members 70 and 72 for purposes of a dorsiflexion type of exercise. Member 70 includes a telescopically arranged slidable extension 74 with rear edge 76 so that heel H can be positioned at a substantial space relative to said edge thereby to avoid fore and aft tilting. Member 72 is provided with an opening or slot 78 to accommodate penetration of the instep of the foot. Member 70, being held on the floor by heel H, constrains movement of strap 30 such that the compressive sandwich of members 16, 18 and 20 yieldingly resist upward pressure from foot 14.

There will now be obvious to those skilled in the art many modifications and variations of the construction set forth hereinabove. These modifications and variations will not depart from the scope of the invention if defined by any one or more of the following claims.

What is claimed is:

1. An exercising device comprising first and second relatively planar members, and resilient means between said planar members and constituting a compression member to yieldingly resist the forcing of the planar members together, the planar member being connected together at an angle and as a monolithic structure, a strap encircling the planar members and resilient means to hold the same in sandwiched relation said exercising device further comprising a third planar member and coupling means to couple said third planar member in rearwardly spaced relation to said second planar member whereby the foot of an operator can be accommodated on the first planar member and the heel of the foot can be accommodated on said third planar member.

2. An exercising device as claimed in claim 1 wherein the coupling means is of adjustable construction.

3. An exercising device as claimed in claim 2 wherein the coupling means includes a Velcro strap.

4. An exercising device comprising first and second relatively planar members, and resilient means between said planar members and constituting a compression member to yieldingly resist the forcing of the planar members together, the planar members being connected together at an angle and as a monolithic structure, a strap encircling the planar members and resilient means to hold the same in sandwiched relation, and a first flat rigid member adapted to support the foot of an exercising person thereon with the planar members and resilient means being supported on the foot with said strap holding the planar members and resilient means on top of said foot.

5. An exercising device as claimed in claim 4 comprising a second rigid member over the planar members and resilient means, said strap further encircling said second rigid member.

6. An exercising device as claimed in claim 5 wherein said second rigid member is provided with an opening to accommodate said foot.

7. An exercising device as claimed in claim 6 wherein said first rigid member is an extensible structure.

8. An exercising device as claimed in claim 5 wherein the strap is positioned to accommodate the foot with the heel thereof in substantially spaced relationship with the rearmost edge of said first member.

* * * * *